US012687019B2

(12) United States Patent
Ward

(10) Patent No.: US 12,687,019 B2
(45) Date of Patent: Jul. 21, 2026

(54) CONCRETE REINFORCEMENT

(71) Applicant: Stanley Wire Limited, Sheffield (GB)

(72) Inventor: Christopher Ward, Sheffield (GB)

(73) Assignee: Stanley Wire Limited (GB)

( * ) Notice: Subject to any disclaimer, the term of this patent is extended or adjusted under 35 U.S.C. 154(b) by 203 days.

(21) Appl. No.: 18/617,933

(22) Filed: Mar. 27, 2024

(65) Prior Publication Data

US 2024/0384534 A1 Nov. 21, 2024

(30) Foreign Application Priority Data

May 16, 2023 (GB) ..... 2307294

(51) Int. Cl.

| | |
|---|---|
| ***E04C 5/06*** | (2006.01) |
| ***B21D 11/12*** | (2006.01) |
| ***B21F 3/02*** | (2006.01) |
| ***E04B 1/04*** | (2006.01) |
| ***E04B 1/08*** | (2006.01) |
| ***E04C 5/01*** | (2006.01) |
| ***E04C 5/03*** | (2006.01) |

(52) U.S. Cl.

CPC ..... *E04C 5/0618* (2013.01); *B21D 11/12* (2013.01); *B21F 3/02* (2013.01); *E04B 1/04* (2013.01); *E04B 1/08* (2013.01); *E04C 5/01* (2013.01); *E04C 5/03* (2013.01)

(58) Field of Classification Search

CPC . E04C 5/0618; E04C 5/03; E04C 5/01; E04B 1/04; E04B 1/08; E04B 1/16; B21D 11/12; B21F 3/02; B21F 27/124

See application file for complete search history.

(56) References Cited

U.S. PATENT DOCUMENTS

| | | | | |
|---|---|---|---|---|
| 918,715 A * | 4/1909 | Wedmore | E04C 5/0618 52/646 |
| 1,372,816 A * | 3/1921 | Holmgreen | B21F 27/124 72/149 |
| 3,214,877 A * | 11/1965 | Akin | E04C 5/08 428/599 |
| 4,119,764 A | 10/1978 | Mizuma et al. | |

(Continued)

FOREIGN PATENT DOCUMENTS

| | | |
|---|---|---|
| EP | 1 469 135 A1 | 10/2004 |
| JP | S48113215 U | 12/1973 |
| WO | 98/29618 A1 | 7/1998 |

OTHER PUBLICATIONS

GB2307294.5 Search Report under Section 17 dated Nov. 24, 2023.
GB2307294.5 Supplementary Disclosures dated Nov. 28, 2023.

*Primary Examiner* — Brent W Herring
(74) *Attorney, Agent, or Firm* — Clark Hill PLC; James R. Foley

(57) ABSTRACT

A concrete reinforcement structure 100 for making a reinforced concrete foundation horizontal beam upright or vertical column comprises a square or rectangular helical coil 101 which is manufactured in a compacted length form and can be pulled out under tension to an extended length, secured within formwork or a trench, and supplemented with additional supporting bars or rods 102-105 prior to having concrete poured into the formwork to form a reinforced concrete foundation or horizontal beam structure. The reinforcement structure can be manufactured on site or can be pre-manufactured in a factory and transported to a construction site.

9 Claims, 13 Drawing Sheets

(56) References Cited

U.S. PATENT DOCUMENTS

| | | | | |
|---|---|---|---|---|
| 7,421,827 | B1 * | 9/2008 | Konstantinidis | E04C 5/0604 52/649.3 |
| 2003/0024204 | A1 * | 2/2003 | Swenson | E04C 5/163 52/712 |
| 2005/0257482 | A1 * | 11/2005 | Galluccio | E04C 5/0618 52/649.2 |
| 2016/0252198 | A1 * | 9/2016 | Babcock | E04C 5/16 52/664 |
| 2020/0283864 | A1 * | 9/2020 | Workman | C21D 6/002 |

* cited by examiner

CONCRETE REINFORCEMENT

FIELD OF THE INVENTION

The present invention relates to reinforcement for concrete.

BACKGROUND OF THE INVENTION

It has been well-known for centuries that concrete as a material is strong under compression, but relatively weaker under tension. For over 100 years it has been common practice to include metal bar or rod reinforcements in concrete in order to prevent concrete structures cracking or failing under tension or compression. Conventionally foundations for buildings, horizontal concrete beams and vertical columns for buildings are reinforced with a reinforcement bar matrix made up of a series of metal hoops arranged in a row and tied together with wire ties.

When laying a foundation of reinforced concrete, typically a trench is dug on-site using a mechanical digger which forms a channel into which fluid concrete can be poured. For lighter duty foundations, the trench can be left without any trench lining, just having an earth wall. For foundations required to take higher loads the trench may be lined with formwork consisting of boards of plywood, wooden or metal shuttering or even blockwork which contains the weight of the fluid concrete which is poured into the formwork around the metal reinforcements. For creation of horizontal concrete beams or vertical columns, a formwork trough is created, either using metal sheet shuttering, or using plywood or reclaimed wood board in order to form a channel within which an internal reinforcement frame can be constructed prior to pouring fluid concrete into the channel around the metal reinforcement frame.

A human operator places a plurality of rectangular or square rebar hoops at intervals along the form work trough. The rebar hoops are not self-supporting and need to be assembled together to form a reinforcement framework structure using one or a plurality of rebar rods, resulting in a structure comprising a series of square or rectangular hoops spaced apart from each other in a row and tied together using one or a plurality of rebar rods, which form the main reinforcing.

The rebar rods need to be tied to the hoops using steel wire, which is a time-consuming manual operation. Alternatively, a human operative can use a gas or electric welder to weld each hoop to at least one rebar rod running along the length of trough or trench. Typically, each hoop needs to be tied or welded to at least two rebar rods to keep the hoop in place assembled to the reinforcement frame structure.

The ties between the rebar rods and the hoops needs to be strong enough to keep the hoops in place with their main planes upright and without the hoops coming loose from the structure or moving as fluid concrete is poured over the structure within the channel.

Due to the large number of wire ties between the hoops and rebar rods required, the construction of a reinforcement frame within a channel of trough or trench is a time-consuming operation which slows up construction and incurs labour costs paid by the hour.

SUMMARY OF THE INVENTION

The embodiments relate to a four-sided tubular reinforcement structure for forming a reinforced concrete ground foundation or ground beam, horizontal or level beam, an inclined, upright or vertical column within a formwork.

According to a first aspect of the present invention there is provided a reinforcing member for a concrete structure, said reinforcing member comprising:

- an elongate drawn wire formed into a four-sided tubular helical member;
- said helical member having a number n of 360° turns;
- each turn having a first width w1 and a second width w2;
- each turn as viewed in a direction along a main central length axis of said helical member comprising four lengths substantially in the form of a rectangle or a square;
- said helical member capable of adopting a first compacted state in which said plurality of turns are compacted along a main length axis of said helical member to a first overall length L1; and
- said helical member being capable of adopting an expanded state in which said helical member expands in a direction along said main length axis of said member to a second length L2.

Preferably a ratio of distance of width w1 to distance of width w2 is in the range w2 is 1.0 to 3 times w1.

Preferably in an expanded in-use form of the helical member, the pitch p between successive turns is in the ratio p=between 1.0 to 10 of the pitch p when the helical member is in a fully compacted state.

Preferably in an expanded in-use condition, the pitch between adjacent successive turns is in the distance range 4 cm to 15 cm.

Preferably in an expanded in-use condition, the pitch between adjacent successive turns is in the distance range 5 cm to 10 cm Preferably in an expanded in-use condition, the plurality of turns of the helical member automatically space out substantially equidistantly between adjacent turns with a substantially constant pitch p, as the tension forces in the coil even themselves out.

Suitably a uniformity of pitch p of the helical member along the length of the member when held between first and second ends on a level surface is p+ or −7%

Preferably said wire comprises a smooth outer surface.

Preferably the wire has a carbon range of 0.04% to 0.20%.

Preferably in a newly manufactured form, a pitch between adjacent successive turns of said member is in the range 0 to 3 times the outside diameter of said wire.

Preferably in an expanded in-use condition a pitch distance between adjacent successive turns of said member is in the range 1 to 30 times and outside diameter of said wire.

Preferably the reinforcing member has a resilient shape memory which causes the helical member to adopt a contracted, as manufactured state when said member is not under tension.

Preferably each single 360° turn of the helical member comprises at least a first upper member, a first side member, a lower member, and a second side member, wherein the first upper member is connected to the first side member by a first corner portion, the first side member is connected to the lower member by a second corner portion, the lower member is connected to the second side member by a third corner portion, and the second side member is connected to the second upper member by fourth corner portion, wherein a radius of curvature of an inner most periphery of at least one of and preferably all of the corners of the wire internal to the tunnel-shaped coil is in the range 0.5 cm to 5 cm.

Preferably the radius of curvature of an inner most periphery of one or more of the corners of the wire internal to the tunnel shaped coil is in the range 1.0 cm to 3.0 cm.

According to a second aspect there is provided a reinforcement structure for a concrete structure beam, said reinforcement structure comprising:

a square or rectangular helical member; and one or a plurality of elongate rods or bars;

said square or rectangular helical member, having a plurality of 360° turns, said helical member capable of adopting a first compacted state in which said plurality of turns are compacted along a main length axis of said member to a first overall length L1; and said helical member being capable of adopting an expanded state in which said member expands in a direction along said main length axis of said member to a second length L2; and each said elongate rod or bar being connected to said helical member at least at a first turn and at a second turn of said helical member, so as to maintain said helical member in said expanded state.

A concrete foundation or concrete beam or other structure may be deployed either horizontally, substantially horizontally, level with respect to the horizontal or at an incline to horizontal, upright or vertically.

Preferably the ratio of distance of width w1 to distance of width w2 is in the range w2 is 1.0 to 3 times w1.

Preferably in an expanded in-use form, the pitch p between successive turns is in the ratio p=between 1.0 to 10 of the pitch p when the helical member is in a fully compacted state, as manufactured.

Preferably in an expanded in-use condition, the pitch between adjacent successive turns is in the distance 4 cm to 15 cm.

Preferably in an expanded in-use condition, the pitch between adjacent successive turns is in the distance range 5 cm to 10 cm Preferably in an expanded in-use condition, the plurality of turns of the helical coil member automatically space out substantially equidistantly between adjacent turns adopting a substantially constant pitch p along the length of the coil when there are no other tension forces expanding the coil laterally.

Preferably in a newly manufactured form, in which the coils lay adjacent to each other and touching each other, a pitch between adjacent successive turns of said member is in the range 0 to 3 times the outside diameter of said wire.

Preferably in an expanded in-use condition a pitch between adjacent successive turns of said member is in the range 1 to 30 times and outside diameter of said wire.

According to a third aspect there is provided a method of manufacture of a cast or poured concrete structure, said method comprising:

assembling a formwork for containing said concrete structure;

placing a reinforcing member into said formwork, said reinforcing member comprising:

an elongate drawn wire formed into a helical coil;

said helical coil having an overall length in which there are a number n turns; each turn having a first width w1 and a second width w2;

each turn as viewed in a direction along a main central length axis of said helical coil comprising four sides;

expanding said reinforcing member lengthwise into an in-use condition in which adjacent successive turns of said reinforcing member coil automatically adopt a substantially evenly pitched spacing;

inserting a plurality of rigid longitudinal members along a main length of said reinforcing member;

securing said plurality of longitudinal members to at least a first turn of said reinforcing member and to at least at a second turn of said reinforcing member to maintain said reinforcing member in expanded lengthwise form; and pouring fluid concrete around said reinforcing member and said elongate longitudinal members.

Suitably, the helical coil forms a tunnel being square or rectangular at any location along the length of the tunnel looking in a direction tangential to a centreline of the square or rectangular tunnel.

During manufacture of a beam or foundation prior to shipping to a construction site, preferably the helical coil is arranged having its main length axis substantially horizontal or level within said formwork such that said plurality of turns extend helically around a main central horizontal axis of said reinforcing member. However, where an upright or inclined beam or foundation is being cast or poured on site, the reinforcing member may be lifted upright so that the main length axis of the helical coil lies upright, and concrete is cast or poured around the reinforcing member contained within an upright formwork.

Where the level of a formwork changes over its length, preferably the coil naturally and automatically flexes to accommodate changes in level and side to side changes in shape of the formwork or trench.

According to a fourth aspect there is provided a method of preparing a reinforcing framework prior to forming a cast or poured concrete structure, said method comprising:

expanding a helical reinforcing member in a lengthwise direction said helical reinforcing member comprising:

an elongate drawn wire formed into a four-sided helix;

said helix having an overall length in which there are a number n turns; each turn having a first width w1 and a second width w2;

each turn as viewed in a direction along a main central length of said helix comprising four sides;

expanding said reinforcing member into an in-use condition in which adjacent successive turns of said member automatically adopt a regular even pitch spacing, by applying tension between a first turn of said reinforcing member located at or near a first end of said reinforcing member and the second turn of said reinforcing member located at or near a second end of said reinforcing member;

inserting a plurality of longitudinal reinforcement bars along a main length of said reinforcing member;

securing said plurality of longitudinal reinforcement bars to at least said first turn at or near said first end of said reinforcing member and a second turn located at or near said second end of said reinforcing member, such that said reinforcing member remains in said in-use expanded condition.

Preferably the method further comprises securing one or more intermediate turns of said reinforcing member, located between said first turn and said second turn to said plurality of longitudinal reinforcement bars.

The invention includes a method of manufacture of a helical coil for a concrete beam structure, said method comprising the stages of:

providing a coil of round wire;

drawing said wire from said coil;

changing a direction of travel of said wire, in order to remove surface scale from said wire;

drawing said wire through a die in order to reduce an outside diameter of said wire;

spooling said wire under tension on to a driven rotating former, having four corners to produce a four-sided helical coil on said former; and cutting said wire after a predetermined number of turns have been wound onto said rotating former.

Preferably the diameter of the wire used to make the helical coil after passing through the die is in the range 7 mm to 16 mm in order to provide sufficient tensile strength to contain the expansive forces of the concrete foundation, beam or other structure.

Preferably the diameter of the wire of the helical coil is in the range 7 mm to 16 mm.

Other aspects are as set out in the claims herein.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILS DESCRIPTION OF THE EMBODIMENTS

There will now be described by way of example a specific mode contemplated by the inventors. In the following description numerous specific details are set forth in order to provide a thorough understanding. It will be apparent however to one skilled in the art, that the present invention may be practiced without limitation to these specific details. In other instances, well-known methods and structures have not been described in detail so as not to unnecessarily obscure the description.

In the following description, the reinforcement structure is suitable for reinforcement of cast or poured concrete structures including foundations, walls, columns, beams and the like.

Reinforcement Structure

Figure 1:
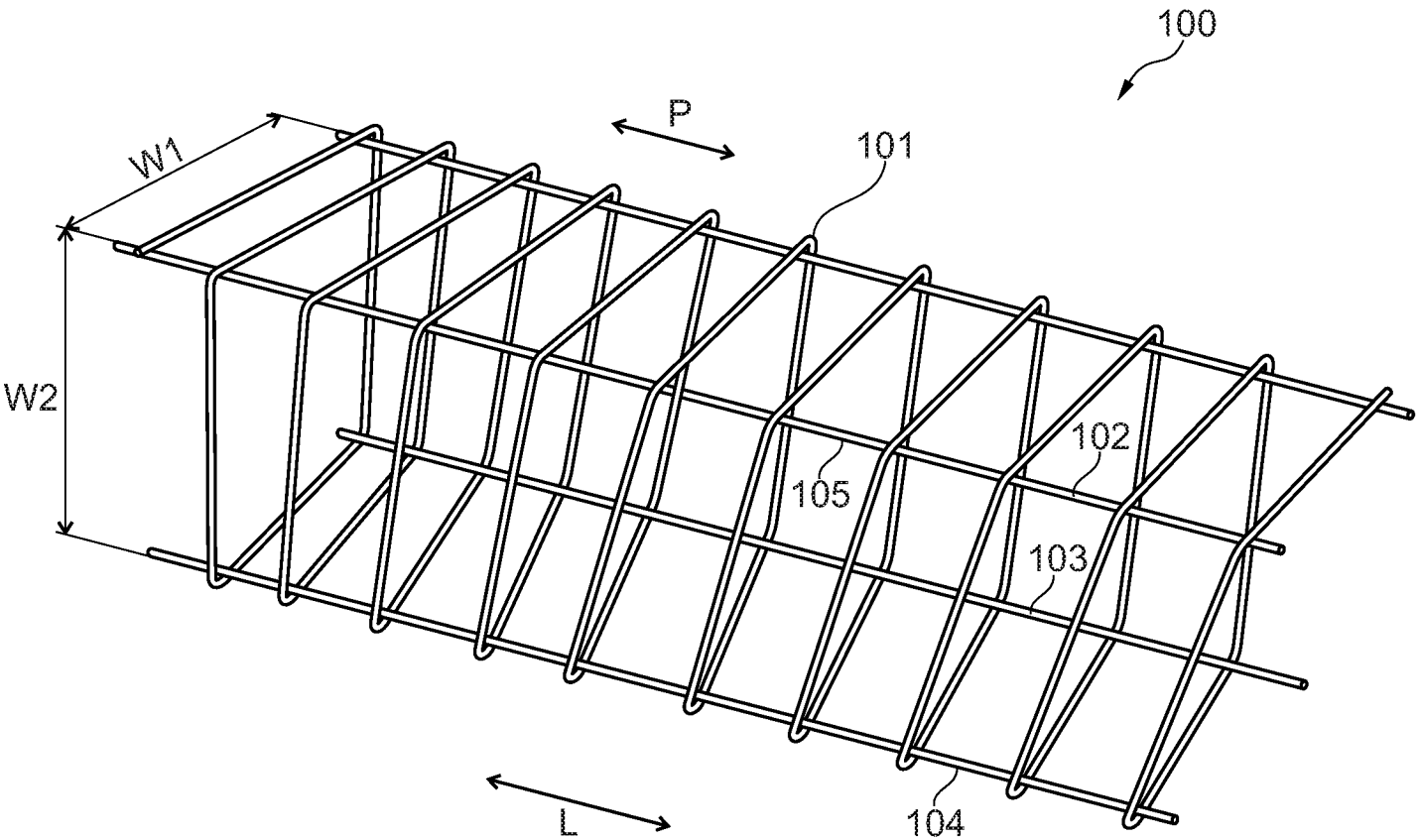
FIG. 1 shows a concrete reinforcement structure comprising an expanded helical member and one or a plurality of elongate support rods extending along the helically member and secured thereto at a plurality of locations along the helical member.

Referring to FIG. 1 herein, there is illustrated schematically a reinforcement structure 100 according to a specific embodiment of the present invention. The reinforcement structure comprises a rectangular or square extended helical coil 101 extending over a length L in an expanded state, and one or a plurality of elongate rods or bars 102-105 extending along the main extended length L of the helical coil member, each rod or bar being secured to the helical member at two or more positions along the length of the helical member coinciding with two or more positions along each rod or bar.

In an as manufactured state, the helical coil is compacted and has a length L1 which is not less than the number of turns of the coil times the diameter of the wire from which the coil is manufactured.

In an expanded state, when stretched out in a straight line the helical coil has individual turns which lie substantially on the sides of a virtual square or rectangular tube having a main geometric central axis running centrally along the virtual square or rectangular tube along a length L2 of the expanded helical coil.

In the example shown, the rods or bars are straight and extend along a direction parallel to a main central length axis of the expanded helical coil. However, the rods or bars need not be parallel to the main central length axis but could lie in a direction lying across the direction of the main central axis of the helical coil.

The helical coil comprises a solid wire having a substantially cylindrical circular cross-section and wound into a plurality of substantially square or rectangular turns. The parameters and dimensions of the coil are preferably in the ranges:

cross-sectional diameter of the solid coil wire—6 mm to 20 mm, and preferably 6 mm to 16 mm;

a preferred diameter of the solid metal coil wire would be around 12 mm;

solid metal wire of cross-sectional diameter of 6 mm, 7 mm, 8 mm, 9 mm, 10 mm, 11 mm, 12 mm, 13 mm, 14 mm, 15 mm, or 16 mm may be particularly suitable, having sufficient strength for use as a tension bearing component in concrete foundations or beams;

a minimum number of turns n depend upon the application to which the reinforcement structure is to be put and can range from 3 turns upwards;

maximum number of turns n is preferably no more than 250 overall;

pitch p between turns when expanded, is preferably in the range 8 cm to 15 cm, the exact pitch p being determined by the number of turns and the overall length L of the coil in expanded form;

pitch p between turns when fully contracted in the longitudinal direction is the same as the diameter of the wire, as each turns lies in contact with a preceding turn and a successive turn, except for the two end turns;

minimum width w1 in a first direction—200 mm;

maximum width w1 in a first direction—1,000 mm;

minimum width w2 in a second direction, substantially orthogonal to the first direction—200 mm;

maximum width w2 in a second direction—1,000 mm;

overall length of coil L2 in axially expanded form—between 30 cm and 10 metres;

overall length of coil L1 in axially contracted close wound (as manufactured) form—the minimum length is the number of turns x the wire diameter—length L1 suitably in the range 4.0 cm to 1.5 m depending on wire thickness and number of turns; and coefficient of thermal expansion in the range $7\times10^{-6}/°$ C. to $12\times10^{-6}/°$ C., and preferably around $10\times10^{-6}/°$ C.

Preferably, the diameter of the wire of the helical coil is in the range 6 mm to 12 mm. However, the diameter of the wire of the helical coil can be selected anywhere in the range 6 mm to 20 mm, for example 6 mm, 7 mm, 8 mm, 9 mm, 10 mm, 11 mm, 12 mm, 13 mm, 14 mm, 15 mm, 16 mm, 17 mm, 18 mm or 19 mm or 20 mm. The exact diameter of the wire or bar is determined by the nominal diameter of the feedstock wire, and by the drawing and pulling process used to manufacture the coil, as set out herein, and is a selectable parameter with an infinitely variable value within the above ranges, subject to engineering tolerances.

For wire thicknesses of diameter above around 16 mm, there is a trade-off between increased manufacturing cost of materials, and increased strength and weight.

Concrete foundations and beams expand and contract depending upon the ambient temperature and season. Preferably the wire from which the helical coil is manufactured has a coefficient of thermal expansion similar to that of concrete, in the range 7 to $12\times10^{-6}/°$ C., with the coefficient being taken into account as a design parameter in the manufacture of the helical coil for a particular specification or application.

The helical coil may be zinc coated or coated in epoxy resin for additional corrosion resistance. Alternatively, in basic form the helical coil may be coated in oil to prevent corrosion during storage or transportation.

In expanded form, the helical coil forms a tunnel or tube where the turns of the coil form the walls of the tunnel or tube. In the example shown in FIG. 1, each of the individual rods or bars 102-105 are secured to the helical coil at internal corners of the rectangular or square tube shape. Each rod or bar 102-105 is affixed to at least two individual turns of the coil, at intervals such that each rod or bar secures the turns of coil in the axial direction along a main central X-X' axis.

However in alternative embodiments, the laterally extending supporting rods or bars may be secured externally of the tube structure on the outside of the coil, or as a combination of some supporting rods or bars on the inside of the coil and some on the outside of the coil.

Although in FIG. 1 the reinforcement structure is shown extended in a straight line, as many applications require a straight reinforced concrete foundation or a straight reinforced concrete beam, the helical coil is flexible enough to follow a predetermined curve or radius, for the creation of curved concrete foundations or beams having a square or rectangular cross-section. For example, a toroidal or donut shaped foundation could be created by taking one end of the helical coil and extending it around a curved form work or trench.

Figure 2:
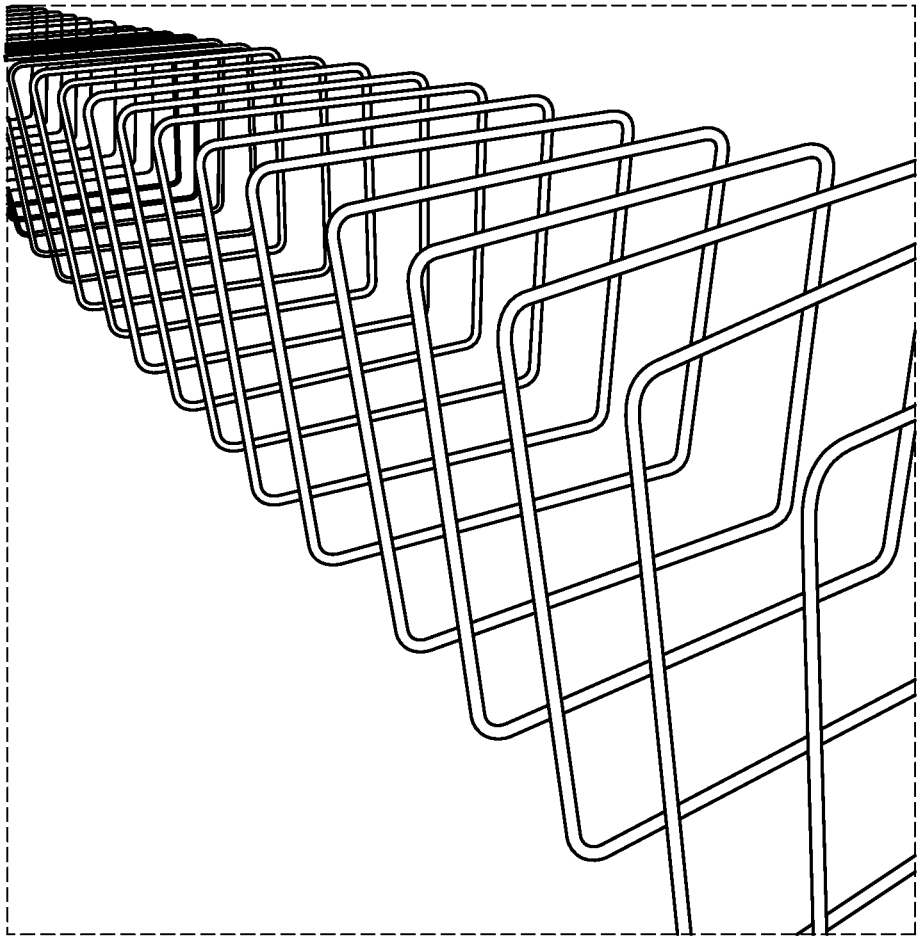
FIG. 2 shows a helical reinforcement member in an expanded state without any longitudinal supporting rods or bars.

Referring to FIG. 2 herein there is illustrated schematically a section of an elongate rectangular helical coil in extended or expanded form. In expanded form, when held at each of its first and second ends, the coil is self-supporting when placed on level ground and adopts a regular and even pitch p between adjacent turns of the coil.

Figure 3:
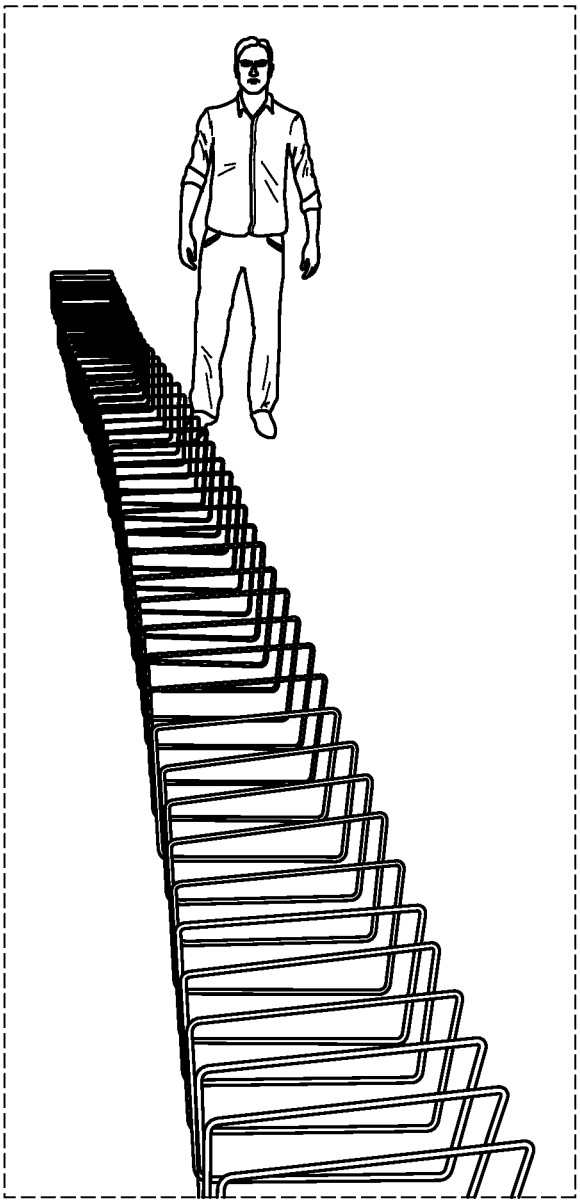
FIG. 3 shows another view of the helical member in an expanded state prior to fitment of further longitudinal supporting rods or bars.

Referring to FIG. 3 herein, there is further illustrated a rectangular helical coil in expanded form when laid on a level surface and held at first and second ends with the natural resilience to contract to its as-manufactured form being overcome by restraining the first and second ends. As shown in FIG. 3, the coil is flexible enough to be displaced in a longitudinal plane, e.g. the horizontal X-Z directions, whilst the individual turns of the coil remain upright in a plane transverse to the longitudinal plane, the Y direction in FIG. 3.

Figure 4:
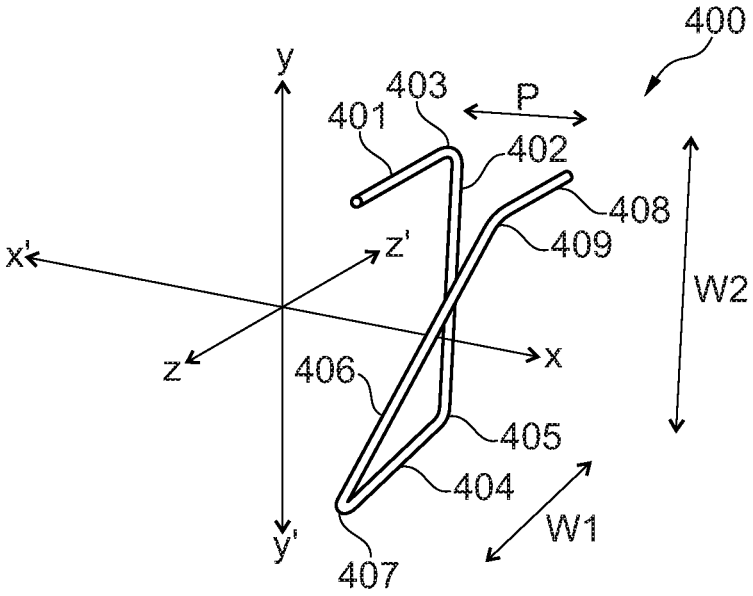
FIG. 4 shows a single 360° turn of a helical coil member in an expanded state in perspective view.

Referring to FIG. 4 herein, there is illustrated schematically in perspective view one individual 360° turn 400 of the helical coil when the coil is under tension. The turn of the coil is shown within a three-dimensional orthogonal coordinate system having axes X-X', Y-Y', Z-Z'. The coil forms a hollow tunnel surrounded by individual rectangular or square turns with a main central axis X-X' running along a geometric centre of each individual term. As the coil may be meandering or curved in the X, Y or Z directions depending upon how it is laid out, the geometric centre points of successive turns may form a meandering line, curved line, or in the case where the coil is stretched out straight, a straight line.

Each individual turn comprises a first upper portion 401 extending halfway across the first width w1 of the turn in a plane parallel to the Z-Z', X-X' plane; a first upright portion 402 extending along a second width w2 in a plane parallel to the y-Y', X-X' plane, and connected to the first upper portion 401 by a first radiused link corner portion 403; at a lower end of the first upright portion 402, there is a lower portion 404 extending along the first width w1 in a plane parallel to the X-X', Z-Z' plane, and which is connected to a lower end of the first upright portion 402 by a second radiused corner portion 405; a second upright portion 406 extending along the second width w2 in a plane parallel to the X-X', Y-Y' plane, a lower end of which is connected to a second lower end of the lower portion 404 a third radiused corner portion 407; and a second upper portion 408 extending in the same plane as the first upper portion 401, one end of which is connected to the second upright portion 406 by a fourth radiused corner portion 409.

Each of the first and second upper portions 401, 408, and the lower portion 404 extend in a direction across and spaced apart from the main length axis X-X'. Similarly, each of the first and second upright portions 402, 406 also extend in a direction which lies across and is spaced apart from the main length axis X-X' of the individual coil turn segment.

Preferably, a radius of curvature of the inner most periphery of the corners 403, 405, 407, 409 of the wire internal to the tunnel-shaped coil is in the range 0.5 cm to 5 cm, and preferably in the range 1.0 cm to 3.0 cm.

The plurality of turns of the coil wind around the main central axis X-X'. Depending on the orientation of the coil and whether it is straight or meandering, the main central axis of the coil as defined by the geometric centres of each turn may be a straight line or curved line or a meandering line.

Figure 5:
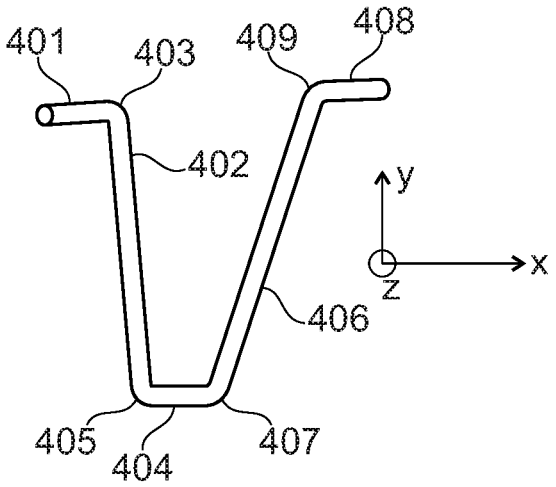
FIG. 5 shows a single 360° turn of a helical coil member in view from one side along a Z-Z' axis which is perpendicular to a main length axis of the turn of the helical coil member.

Referring to FIG. 5 herein, there is illustrated schematically in view along the line z-z' the individual 360° turn shown in FIG. 4 herein.

Within a three-dimensional space having axes x-X', Y-Y', Z-Z' with the axis X-X' being perpendicular to a generally upright plane Y-Y', Z-Z' bisecting the individual turn at a midpoint of the lower full portion 404 of the turn, each of the individual portions 401, 402, 404, 406, 408 lies at an angle to the flat plane Y-Y', Z-Z'.

When the coil is extended, as the tension pulling the ends of the coil apart increases by stretching the coil, the angles between the individual portions 401, 402, 404, 406, 408 and the plane Y-Y', Z-Z' increase as the coil becomes more stretched. As tension along the coil decreases by releasing the ends of the coil so that the coil contracts towards its as-manufactured state, the angles between the individual portions 401, 402, 404, 406, 408 and the planes Y-Y', Z-Z' decrease and each individual turn of the coil becomes more compacted in the X-X' direction.

Materials

In the embodiment shown, the wire feedstock is preferably steel having a composition with a carbon range of 0.04% to 0.20%.

In alternative embodiments, the helical coil may be formed from glass fibre reinforced plastic (GFRP) in which case the fabrication method is similarly as herein described, except that longitudinal GFRP rods or rebar are tied to the helical coil longitudinally along the coil using nylon straps, cable ties, or plastic clips. Glass fibre reinforced plastic may be used in applications where a lighter and easier to lift reinforcement structure is required, or where a concrete foundational beam is to be created which resists chemical corrosion.

Method of Fabrication of Reinforcement Cage Structure

The reinforcement cage may be manufactured on site at a construction site, or in a factory for shipment to a final construction site in a prefabricated form.

In the case of on-site fabrication of the reinforcement cage at a construction site where the cage is to be used, the helical coil arrives on site in compact un-extended form, optionally packaged in plastic wrap, and is lifted to near where the concrete beam of foundation is to be created. The reinforcement cage can either be constructed in situ within the form work, or in a trench where the concrete beam or foundation is to be made or it can be constructed adjacent the formwork or trough as is convenient to the construction workers and work plan.

The contracted helical coil has its packaging removed and is then stretched out on the ground manually by restraining one end of the coil and manually pulling the other end of the coil so that the coil expands in a bellows like manner. Due to the shape memory of the helical coil, the individual 360° turns of the coil retain a substantially square or rectangular shape as viewed in a direction perpendicular to the two widths w1, w2 of the coil at any position along the length of the coil, and each individual turn expands in the direction along a main axial length of the helical coil at a local position of that turn, so that successive turns form a tunnel or tube which can be straight, if laid out in a straight line, or follow a curved or serpentine path depending on how the helical coil is laid out in the formwork or trench.

Once the helical coil is expanded to the required length being held in place at each end, due to the resilience of the coil the pitch p between individual turns can be made uniform and consistent by shaking or kicking the expanded coil and relying on the resilience of the coil to automatically space the turns of the coil at regular even intervals of pitch p between successive turns, that is to naturally adopt a substantially constant pitch p between successive adjacent turns.

A human operator may then take a straight or bent rod or bar 102-105 and connect the bar to individual turns of the coil. In the example shown in FIG. 1, the reinforcement structure is shown in a linear straight line, and substantially straight rod 102, 105 is attached to the expanded coil tunnel which holds the coil in expanded state against its natural tendency to contract lengthwise. Each rod, for example first rod 102, is secured along its length to at least two separate turns by manually applying a twisted steel wire around the rod and an internal corner or other portion of a first turn, and manually applying a twisted wire around the same rod and an internal corner of a second turn spaced apart from the first turn. Where the first and second fixing points are at or near the ends of the rod, the rod will maintain the coil in expanded condition over the length of the rod. In some instances ratchet type cable ties may be used instead of wire ties, alternatively, the rod can be fixed to the coil by welding.

To avoid the coil becoming skewed and to give additional rigidity, further rods 103-105 are added. However, the helical coil has basic shape memory and rigidity when expanded and the number of rods needed to add rigidity to the overall reinforcement structure may be fewer than compared to the prior art case involving a plurality of closed hoops. Further, the number of securement points of each rod is much reduced compared to prior art structures using closed hoops where every single hoop has to be secured at more than one point to more than one rod.

Alternatively, instead of using wire ties to secure the longitudinal rods to the expanded coil, the rods can be welded to the turns. The number of welds required is far fewer than for the equivalent prior art reinforcement structure made of closed loop hoops and rebar rods.

In either case, the saving in time and labour in constructing a reinforcement structure according to the present embodiments is significant compared to an equivalent prior art structure fabricated from closed loop hoops and lengths of rebar.

Due to the resilience and springiness of the helical coil, although the helical coil has a tendency to naturally adopt a consistent fixed pitch distance p between successive adjacent turns it is possible to bunch up a number of turns, for example in a central region of the expanded coil if a higher number of turns per linear metre is required compared to other parts of the helical coil. This might occur where a particular part of the foundation or beam has to carry an additional load compared to the rest of the beam or foundation and therefore extra reinforcement is required in the load bearing region. For example, a beam or foundation could be constructed where a first region of the length of the foundation has a first number n1 turns per metre of length, and the second region of the foundational beam has a second number n2 of turns per metre of length, where n1>n2.

Where a pre-manufactured length of helical coil is used which is longer than required for a particular section of foundation or beam, manual operatives can stretch out the helical coil to the desired number of turns per metre of axial length, and if there is excess helical coil, the coil can be cut with an angle grinder or disc cutter.

Similarly, where a length of foundational beam is required which is longer than a pre-supplied length of expanded helical coil, expanded to the desired number of turns per metre, two or more helical coils can be connected in series, by connecting a second end of the first helical coil to a first end of the second helical coil, either using welding, wire ties, clamps or other securement means. Alternatively, two successive lengths of helical coil in series, can be connected longitudinally by one or more rods or rebar lengths.

Creation of the foundation or beam itself is by pouring fluid concrete over the reinforcement structure within the formwork or trench in order to surround the reinforcement structure and waiting for the concrete to set.

Figure 6:
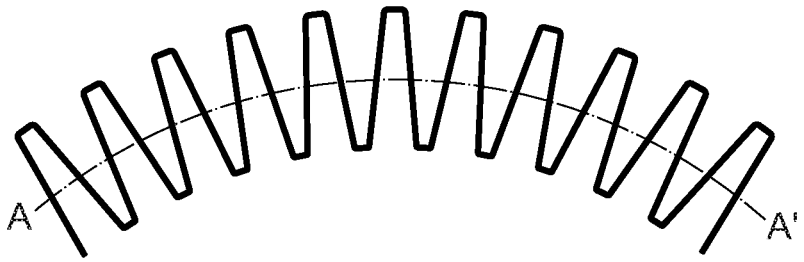
FIG. 6 shows schematically in plan view a helical coil member arranged in a curved orientation along a central line axis A-A'.

Referring to FIG. 6 herein, for creation of a curved foundation, for example in a 'C' shape, 'U' shape or 'S' shape when viewed from above, the method of manufacture is as above, but with the following differences.

The helical coil is arranged in a trench or formwork in the plan view curved shape which the foundation or beam is to take. The helical coil retains a substantially rectangular or square cross section as viewed in a line tangential between the geometric centres of a pair of successive turns. When viewed along a longitudinal direction of the coil, at any position along the length of the coil, the shape of the turns of the coil are four sided with rounded turns at each corner.

When the helical coil is laid on a flat bed and is deployed in a curve or arc, the turns of the coil tend to naturally adopt a radial spacing of regular even radial angles about the centre of curvature of the curve or arc.

Figure 7:
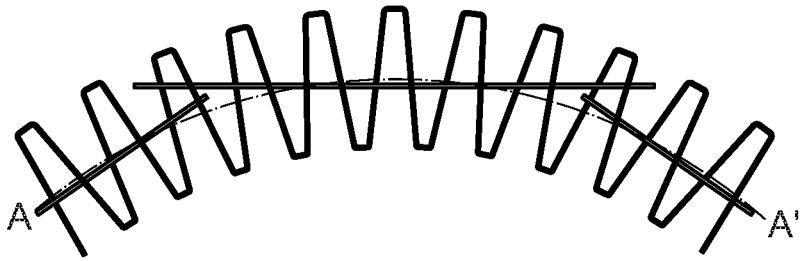
FIG. 7 shows schematically in plan view the helical coil member of FIG. 6 having added longitudinal stabilizing bars or rods connected to the turns of the coil.

Referring to FIG. 7 herein, wire rods or rebar rods are attached to turns of the coil by smaller wire ties, or by welding or using cable ties in order to secure and make more rigid the curved metal reinforcement structure ready for pouring concrete around the coils and rods.

Figure 8:
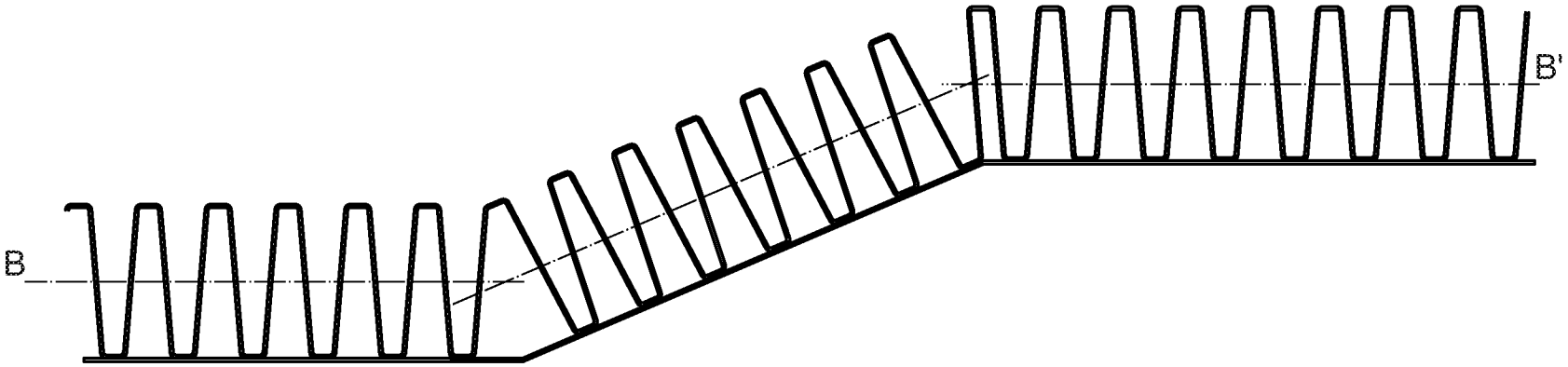
FIG. 8 shows schematically in elevation view from one side an expanded helical coil member arranged on a variable level ground or formwork between a first upper level and a second lower level with an inclined transition between levels, where the central axis of the helical coil B-B' follows the contours of the ground or formwork.

Referring to FIG. 8 herein, the extended helical coil can also accommodate or adapt to being laid in a range of shapes at different ground levels and inclines. For example where a foundation or ground beam is to be created continuously between a first level 800 and a second level 801 with an inclined transition 803 ramp therebetween lying at an angle to horizontal, the helical coil can be laid extended between and along the first and second ground levels and across the inclined transition portions. The helical coil is laid out by extending the ends of the coil and securing each end of the coil to prevent the coil contracting due to its inherent resilience and shape memory when manufactured. The turns of the coil automatically adopt a regular even spacing, and with assistance by shaking the coil to overcome friction between the coil and the ground or base of the formwork, the coil adopts an optimum spacing between turns without the need to measure the spacing between each successive turn (the pitch p between turns). When transitioning between the first and second levels, the turns of the helical coil automatically and naturally adopt an appropriate pitch to traverse the variable ground level or formwork base level which coincides with the minimum tension in the coil and results in an automatic spacing between the turns of the coil to suit the horizontal shape. The spacing of the coils is determined by evening out the tension within the coil, to which the coil naturally adjusts.

Figure 9:
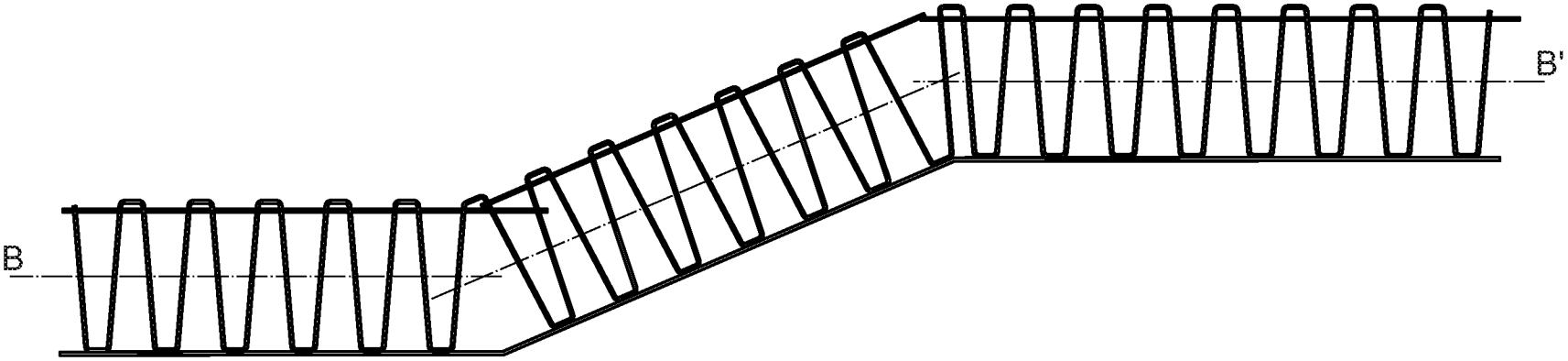
FIG. 9 shows schematically the helical coil of FIG. 8 with added laterally extending reinforcing or strengthening bars each secured to at least a pair of turns of said helical member.

Referring to FIG. 9 herein, having secured the ends of the coil and the coil having adopted an optimum turn spacing along its length with minimum effort from the worker, the worker may then tie off or weld rebar or rod lengths to at selected positions to selected turns of the coil to improve the rigidity of the structure. Due to the self-supporting nature of the coil, the number of locations at which the coil needs to be secured to the lateral rods or rebar is minimized, thereby minimizing the time taken to create a rigid reinforcement structure. Once the coil has been extended and additional rigidity applied by securing laterally extending rods or bars, the fluid concrete mix is poured around the reinforcement structure and left to set to form a finished reinforced concrete foundation or lateral beam.

Referring to the example shown in FIG. 9 herein, the reinforcement structure could alternatively be created away from the formwork on level ground by extending the coil lengthwise and moving over a first part of the coil intended for the first level to be offset relative to a second part of the coil and securing rods along the length of the coil, so that the plan view of the reinforcement is the same shape as the elevation view of the formwork, and then lifting the finished reinforcement with a telehandler or the like into the formwork, rotating by 90° about its length axis to fit the formwork.

If fabricated adjacent or away from the formwork or trough in which it is to be used, when completed, the prefabricated structure can be lifted into the trough formwork using mechanical handling equipment such as a fork loader, telescopic handler, crane, digger or the like, or depending on its weight can be manually lifted.

Off-Site Factory Fabrication

In the case of factory fabrication away from a building construction site, a helical coil member as described herein above is pulled out to expanded form on the ground or on a platform or pre-built former for more efficient mass production. The coil is extended with its two ends secured apart under the natural tension of the coil as described herein above.

In automated machine fabrication, the welds may be made by a welding machine or robot welder, and the completed reinforcement cage then stored horizontally for later delivery or loaded by a hoist or crane onto a flat be truck for delivery on site. When on site, the prefabricated reinforcement cage is lowered into a formwork trough or channel, laying with its longest main length axis substantially horizontal and, depending on the final form of concrete structure required, the prefabricated cage structure may be tied to other reinforcement members to form a longer combined reinforcement structure.

On site, fluid concrete is poured into the form work trough or channel around the prefabricated reinforcement cage structure and left to set. Where an upright concrete structure is being created the reinforcement structure can be positioned upright with the main longitudinal axis of the helical coil being upright, to create a concrete column or the like.

Method of Manufacture of Helical Reinforcement Member

In the best mode method, the helical coil member is manufactured as follows. The method of manufacture comprises providing a reel of round wire on a spindle bobbin, drawing the wire upwards off the reel, changing a direction of travel of the wire, passing the wire around a roller to effect a first 180° change of direction, passing the wire around a second roller oriented with its axis of rotation across the axis of rotation of the first roller, in order to effect a second 180° change of direction in order to remove any external caking on the surface of the wire; passing the wire through a die having a circular aperture of internal radius less than the outer radius of the wire fed into the die in order to reduce the diameter of the wire as it comes out of the die; passing the wire through a series of nip/pinch rollers which induce tension in the wire and then the wire is wound onto a former having four corners extending in a direction across a travel direction of the incoming wire in order to create a four-sided helical coil on the four-sided former; after a predetermined number of turns have been wound onto the former, cutting the wire to release a cut helical wire coil and sliding the cut helical wire coil off an open free end of the former.

Figure 10:
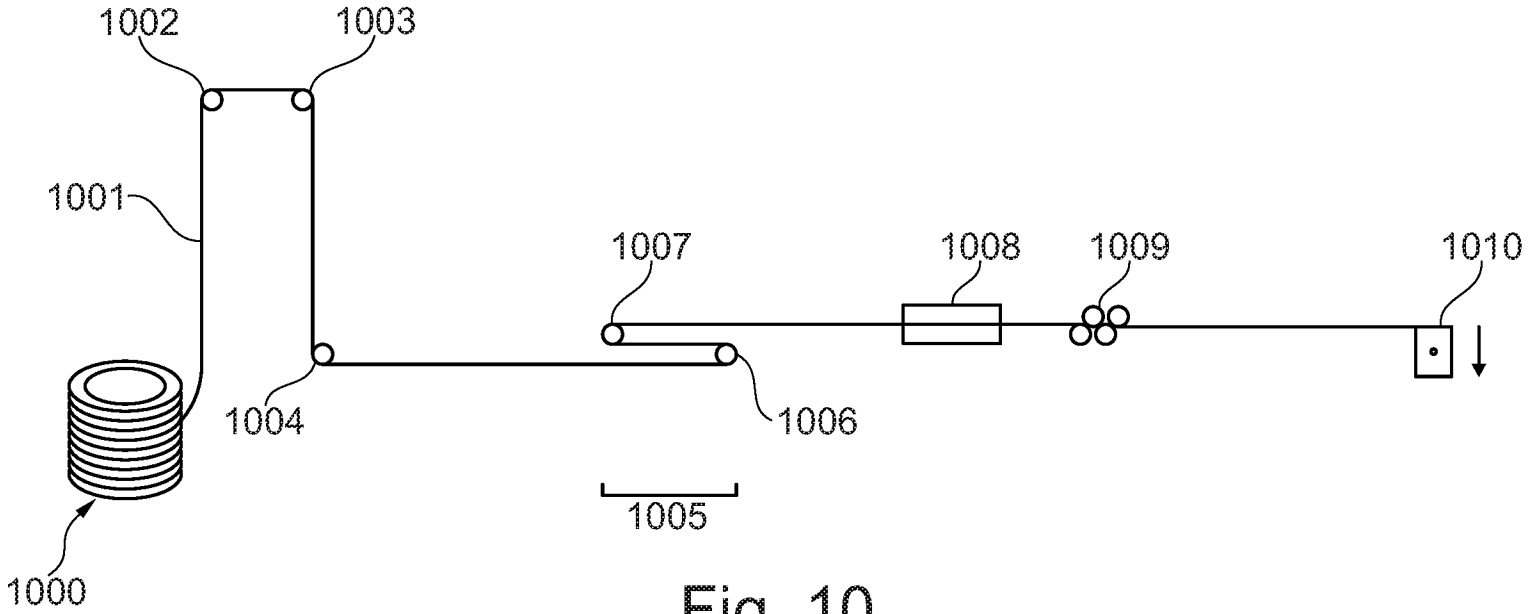
FIG. 10 shows schematically production line processes for continuously manufacturing a four-sided helical coil as described herein.

Referring to FIG. 10 herein, a reel 1000 of wire 1001 of the selected gauge and material properties is manufactured by a known method and supplied on a reel and is used as the wire feedstock. In a first stage, the wire 1001 is drawn off its reel carrier 1000 upwards, passed over a first roller 1002, along to a second roller 1003 and then transported downwards to a third roller 1004 which removes some of the shape memory of its original shape on the reel, and makes the wire straighter and easier to work with. The wire is drawn off the reel in a direction which lays across a direction tangential to the round turns of the wire supplied on the feed reel. The wire is fed from the third roller in a substantially horizontal path towards a second processing stage 1005 which de-scales the wire.

Figure 11:
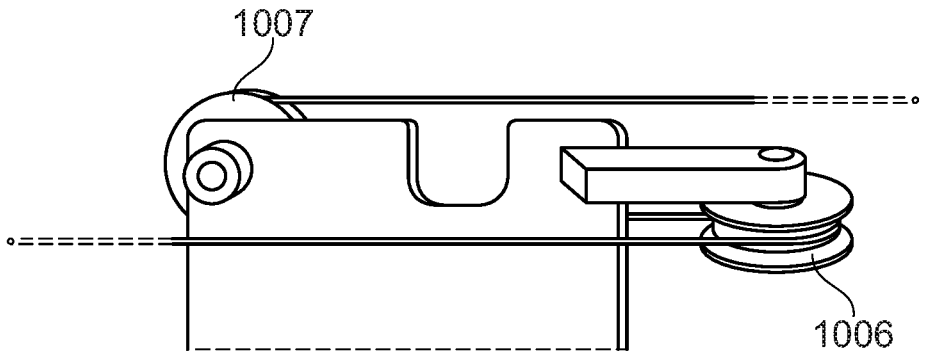
FIG. 11 shows schematically a switch-back stage of the production line for reversing a direction of travel of a wire feedstock, in order to remove external coating or scale from the wire feedstock.

Referring to FIG. 11 herein, when the wire is originally hot rolled then cooled, this forms a scale on the outside of the wire. The scale is removed by reverse bending the wire. In the second stage 1005 the direction of travel of the wire is reversed and then reversed again by a set of two rollers 1006, 1007. A horizontally oriented roller 1006 having an upright or vertical axis of rotation reverses the lateral direction of travel of the wire by 180°. Roller 1007 which rotates about an which lies across the rotational axis of the roller 1008, for example 90° reverses the direction of travel of the wire by a further 180° back to its original direction of travel, so that the two rollers together operate to bend the wire in a first radial direction of the wire, changing its direction of travel, bend the wire in a second radial direction of the wire, where the second radial direction lies across the first radial direction, and then reverses the direction of travel of the wire a second time.

The radius of each roller 1006, 1007 is selected so as to flex the wire sufficiently that "caking" of any surface scale material or surface layer on the wire is removed as it flakes off under bending. This stage also works the wire to further help to remove any shape memory it may retain from being originally wound on to the feedstock reel 1000.

In a third stage 1008, the wire is drawn through a die aperture and back tension is applied to the wire. The diameter of the aperture is selected to result in the final diameter of the wire for when formed into the helical coil. The wire is pulled through the aperture by the rotating tooling/former on the far, downstream side of the aperture. Friction through this stage is reduced by the application of solid soap lubricant as the wire passes through a bath of solid soap granules before entering the die aperture.

Figure 12:
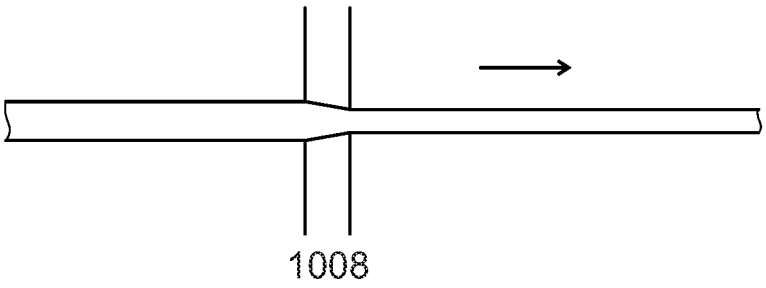
FIG. 12 shows schematically a gauge reduction stage for reducing a diameter of a solid wire drawn through a die.

Referring to FIG. 12 herein, there is illustrated schematically the third stage 1008 being the die stage. The wire is pulled through a die in order to reduce the diameter of the wire to the required diameter for forming the helical coil.

Figure 13:
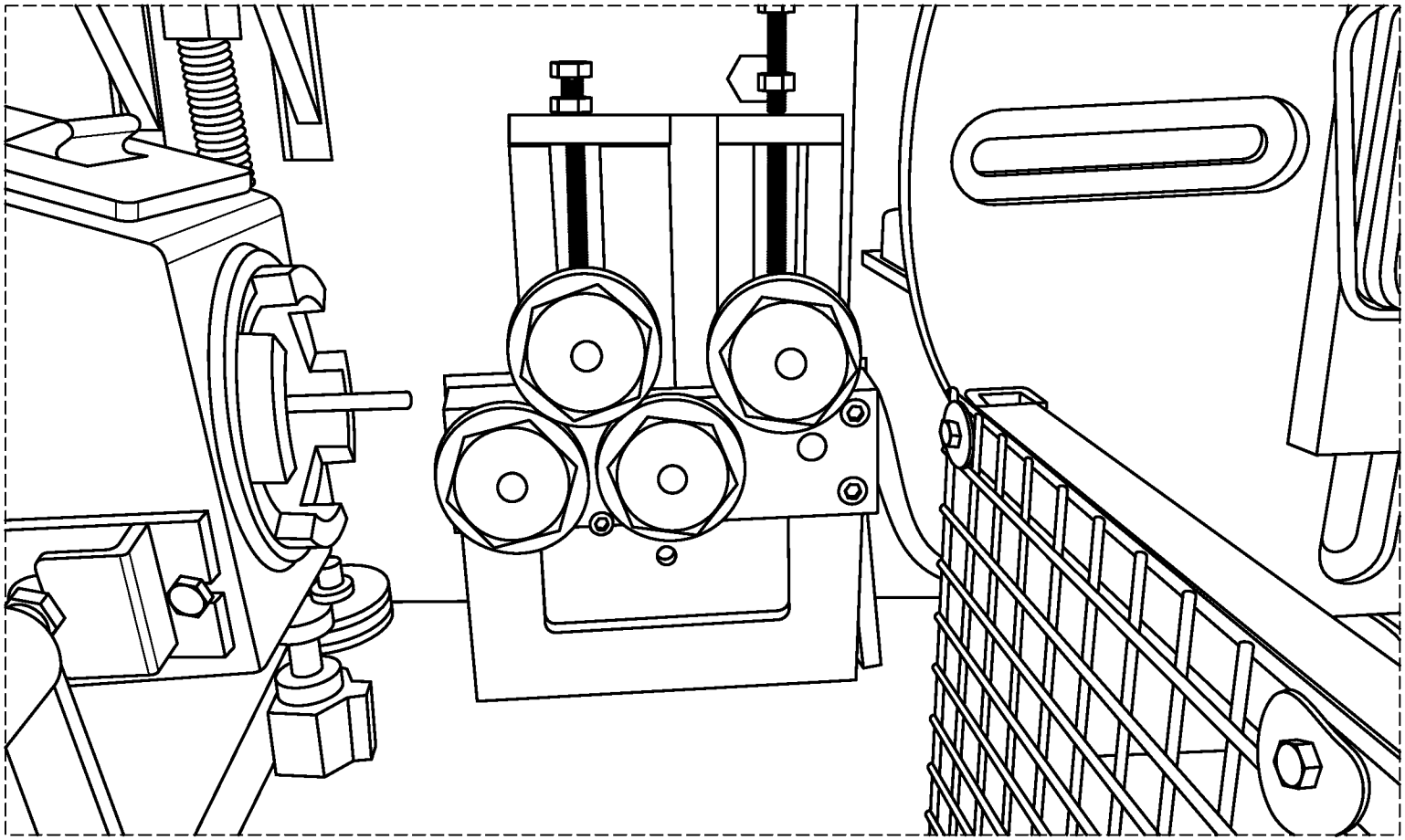
FIG. 13 shows schematically a set of pinch rollers through which the wire is passed after exiting the die, and prior to feeding the wire feedstock onto an electrically driven rotating coil former.

Referring to FIG. 13 herein there is illustrated schematically a set of rollers of the fourth stage 1009. The rollers flex the wire through a serpentine path passing through successive individual rollers prior to winding onto the rotating coil former.

The wire enters a fifth stage 1010 of a rotating former onto which the final helical coil is formed. The rotating former, in the best mode comprises four spaced apart rigid circular bars supported on a circular disc base plate which is driven by an electric motor and his rotated at a speed which applies tension to the wire exiting the fourth stage of rollers, and successively winds the wire in a coil the main length axis of which is perpendicular to the direction of travel of the wire onto the coil former.

The rotating former is powered by an electric motor, which controls the winding speed of the wire being formed on to the rotating former.

Figure 14:
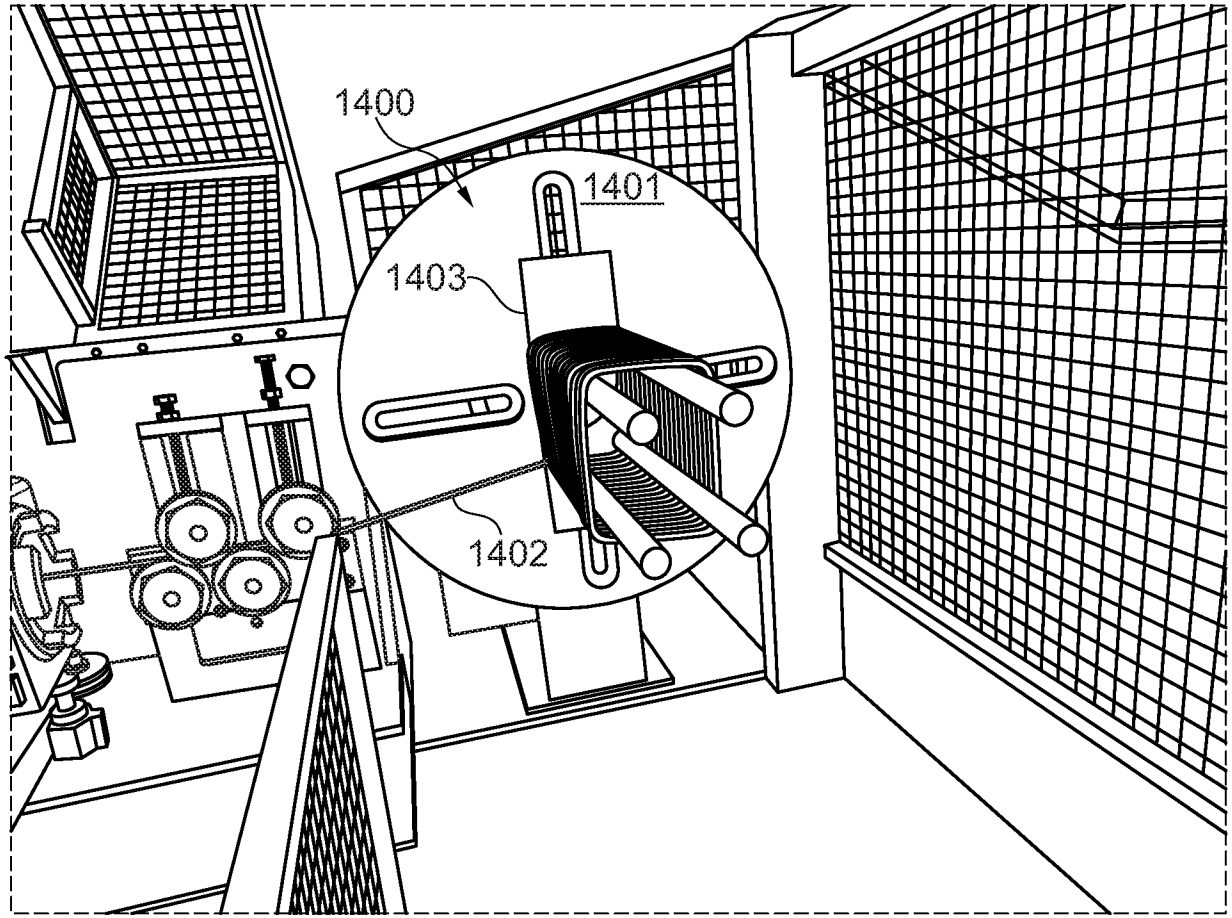
FIG. 14 shows schematically a rotatable coil former for forming a square or rectangular helical coil.

Referring to FIG. 14 herein, the rotating former stage 1400 comprises a rotating spindle powered by an electric motor and an associated drive circuit. On to the rotating spindle is secured a disc-shaped mounting plate 1401 which carries a four-pronged former 1402 onto which the wire is wound. The former comprises a square or rectangular base plate 1403 extending along a main plane, and four parallel circular cylindrical solid bars spaced apart from each other and extending in a direction perpendicular to the main plane of the base plate, so that the central axes of the bars are arranged on the four corners of a square or rectangle. The internal dimension of the wire turns is determined by the spacing of the four solid bars of the former as the wire is wound around the outside of the former.

The helical coil production machine can be set up to manufacture a range of helical coils of different dimensions, by stopping wire production and re-setting or re-configuring the machine to produce a different size rectangular or square coil. To change the width dimensions w1, w2 of the turns of the helical coil requires changing the former on the spindle for a different former having different bar spacings. Each size of coil requires a separate former tooling.

The base plate of the former tooling is bolted on to the revolving circular disc plate via a plurality of elongate slots having straight sides and semicircular ends.

Figure 15:
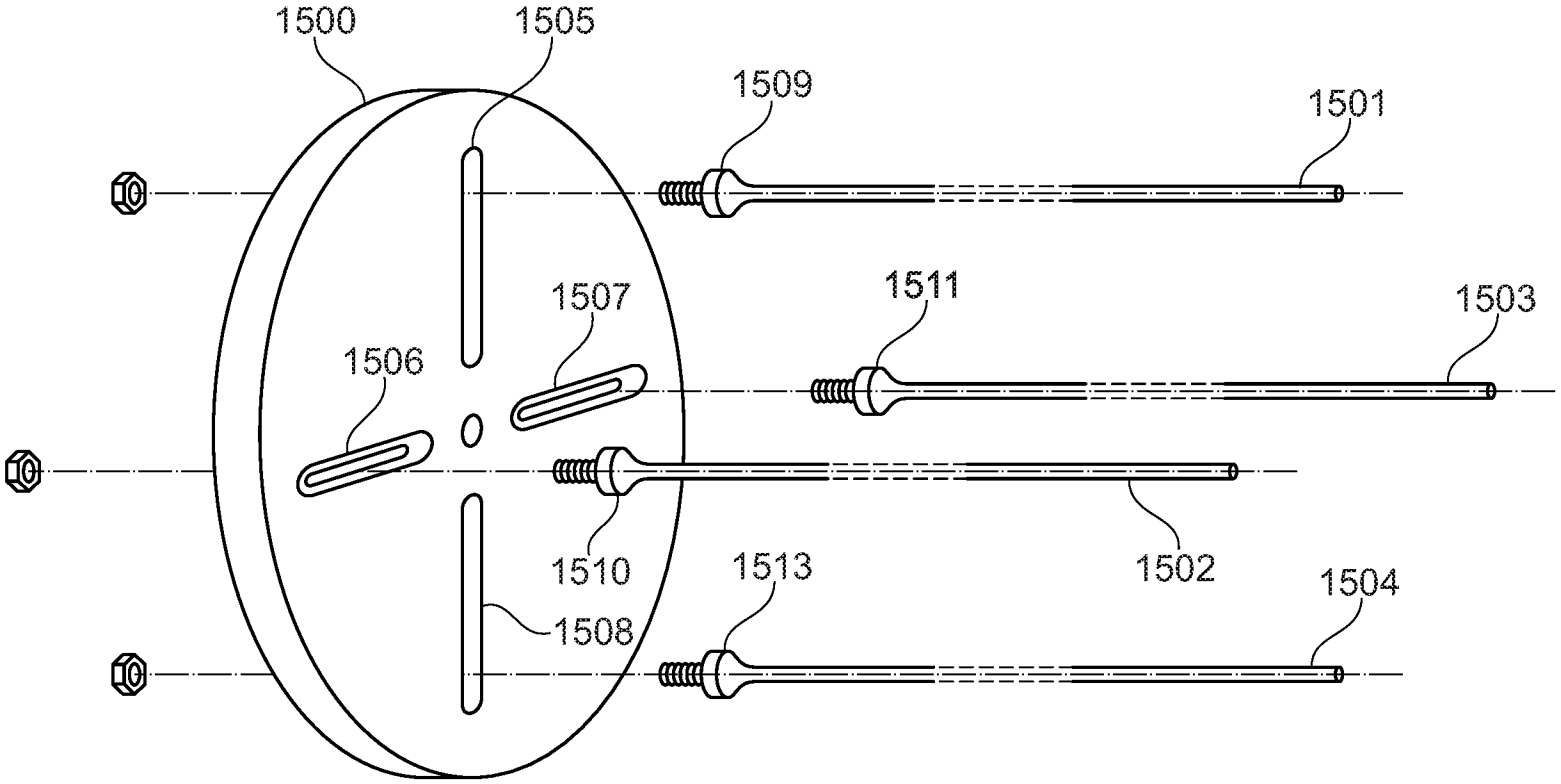
FIG. 15 shows schematically an alternative embodiment coil former having adjustable spacings to accommodate a range of sizes of square or rectangular helical coils.

Referring to FIG. 15, herein, in an alternative configuration, instead of the former comprising a rectangular or square base plate bolted to the circular plate, which requires a different former for each size of helical coil to be manufactured, the former may be an adjustable former comprising four solid rigid bars 1501-1504 bolted directly to the circular disc plate 1500. In this arrangement the circular plate comprises a flat circular steel disc having four radially extending elongate slots 1505-1508, having semicircular ends each slot extending between a central axis of rotation of the disc and an outer perimeter of the disc plate, and four elongate rigid bars or rods one per slot. Each individual rod comprises a circular cylindrical elongate portion of solid metal, having at one end a radially larger portion 1509-1513 which fits inside the slot of the baseplate, the radially larger portion having a flat annular face which mates to a threaded portion extending from the radially larger portion. At a distal end of each rod there is a threaded portion which extends through the slot and is secured to the rear of the base plate by a nut, which is preferably a self-retaining nut which will not come loose, for example a spring nut or an aero nut.

Each slot 1505-1508 comprises a straight portion, having a semicircular portion at each end. Each slot has a recessed closed loop Panathenaic track shaped ledge surrounding a slot aperture (also shown in FIG. 14), the ledge being recessed within the depth of the plate, so that the relatively wider ends of the rods can be recessed below the outer flat surface of the circular plate, leaving the smaller radius main length of the rod extending from the plate. Use of a larger radius base to the rods gives a stronger connection between the Panathenaic track and slot of the circular base plate and the individual rod.

After formation, the helical coil on the former is cut at a position one or two turns from the circular base plate so as to leave enough turns of wire on the former to continue winding the next coil, without having to re wind any wire onto the former prior to the next coil to be made. The cut coil is slid off the former in an axial direction along the length of the once, for example onto a carrier, or can be just left loose in its compacted as-manufactured form.

The completed helical coil may be dipped in epoxy or other coating to prevent surface corrosion or may be dipped in oil or grease or like protective coating to prevent surface corrosion prior to delivery to the end user.

Figure 16:
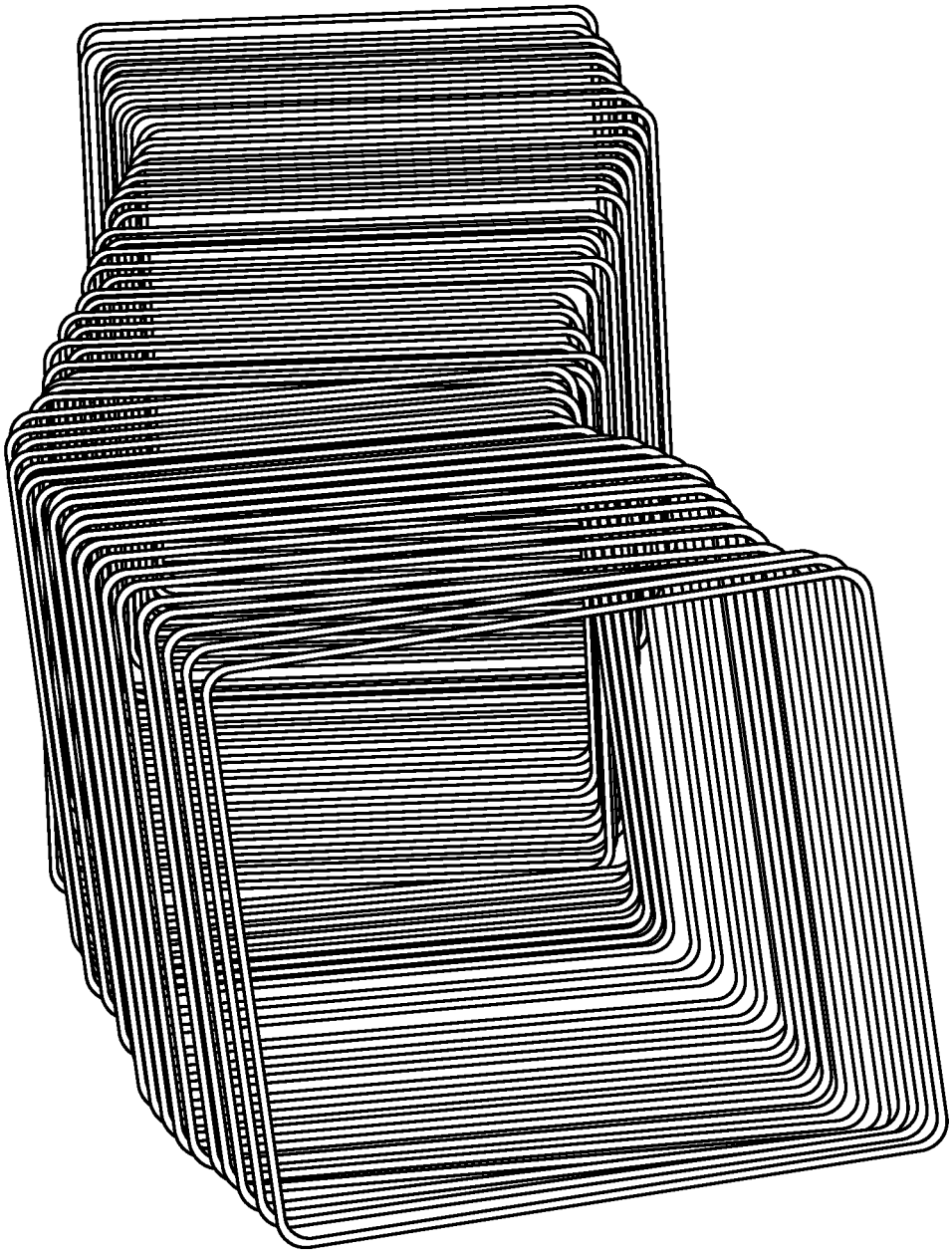
FIG. 16 herein shows a newly manufactured helical wire coil in its as-manufactured compact state.

Referring to FIG. 16 herein there is shown in perspective view a newly manufactured helical wire coil in its as-manufactured compact state, lying loose. In the newly manufactured state, the coil is loosely compacted to it as manufactured length L1.

In the above description, foundations or beams are poured or cast optimally when the reinforcement structure is laid out level or horizontally so that the weight of the coil is supported on one side of the coil with gravity acting in a direction transverse to the main length axis of the coil. Prior to addition of strengthening rods or rebar, the loose tubular helical member naturally adopts a regular even spacing between turns when the weight of the coil is acting in a direction transverse to a main length direction along the centre of the tubular coil.

Whilst beams are optimally manufactured horizontally, where a column is made these are usually cast in situ at the construction site, so shuttering or formwork is put in place, a reinforcement structure added, and then concrete is poured into the shuttering around the reinforcement structure.

It is also possible that a concrete column can be made in a horizontal state, cast around a horizontally oriented reinforcing structure as described herein, and then put in place on a construction after removing the column from the shuttering when the concrete has set.

Where a reinforcement structure as described herein is pre-manufactured with the helical coil laid out level on the ground and welded or tied to make a rigid reinforcement structure, either in a factory and shipped to a construction site, or created from the coil and longitudinal rods or bars at a convenient location on the construction site, then once in rigid final form, the reinforcement member can be hoisted into an upright or vertical position within an upright formwork and concrete poured around it to form a column or beam in situ.

For a prefabricated reinforcement structure assembled on a level surface, which already has the structural strengthening support rods secured to the helical coil by welding or tie attachments these are already rigid and have rigid coil spacings and can be lifted upright into place inside an upright formwork, for example to make an upright beam.

It is also possible to ship a compacted coil as described herein to a construction site where workers will suspend the loose helical coil from one end in an upright or vertical formwork, tie or weld the strengthening rods or bars to the suspended coil to create the reinforcement structure, create formwork or shuttering around the reinforcement structure, or create the reinforcement structure within a preassembled formwork or shuttering, and then pour fluid concrete into the formwork or shuttering around the upright reinforcement structure.

Advantages

The reinforcement structure disclosed herein has the following advantages:

there is a significant time saving when creating a reinforcement cage at a construction site compared to prior art reinforcement structures. Instead of using a plurality of separate individual hoop components to create a tunnel, each of which needs to be held in place whilst being secured to a rebar, and each of which needs to be separately secured to a supporting rod or bar, in the embodiments herein, a single helical coil tunnel is used which quickly and easily expands under tension and only needs to be secured at both ends to maintain an expanded form;

the helical coil automatically adopts a regular and even pitch spacing between adjacent coils, removing the need for a human operator to space individual closed-loop hoops and retain them in an upright state;

when making the structure more rigid using straight wire rods or rebar, each individual turn does not need to be secured to a rod or Rebar because the turns are continuous and the helical coil remains rigid and upright as long as each end remain secured. This significantly reduces the amount of ties or welds required to create a rigid three-dimensional reinforcement structure, thereby reducing construction time and reducing the cereals used;

the reinforcement structure can be fabricated in situ within a trench or formwork, or can be fabricated on site adjacent a trench or formwork and lifted into the trench or formwork in a rigid state, or it can be prefabricated at a factory, loaded onto transport vehicles, and delivered on-site, stacked or stored on site, and then lifted into a trench or formwork ready for use, thereby cutting down on on-site labour requirements and reducing on-site construction time; and because the reinforcement structure is quicker to assemble from a compactor coil and because it can be prefabricated off-site and delivered, and then lifted into location, it does not hold up construction timetables and enables faster construction of foundations or beams or columns on site.

The invention claimed is:

1. A reinforcing member for a concrete structure, said reinforcing member comprising:

an elongate drawn wire formed into a four-sided tubular helical member;

said helical member having a number n of 360° turns;

each turn having a first width w1 and a second width w2;

each turn as viewed in a direction along a main central length axis of said helical member comprising four lengths substantially in the form of a rectangle or a square;

wherein each single 360° turn of the helical member comprises a first upper member, a first side member, a lower member, and a second side member, wherein the first upper member is connected to the first side member by a first corner portion, the first side member is connected to the lower member by a second corner portion, the lower member is connected to the second side member by a third corner portion, and the second side member is connected to the second upper member by a fourth corner portion;

said helical member being manufactured in a first compacted state in which said plurality of turns are compacted along a main length axis of said helical member to a first overall length L1; and said helical member being capable of adopting an expanded state in which said helical member expands in a direction along said main length axis of said member to a second length L2;

said helical member having a resilient shape memory which causes the helical member to adopt a contracted, as manufactured state when said member is not under tension such that each turn lies in contact with an adjacent turn;

wherein in an expanded in-use condition, the plurality of turns of the helical member automatically space out substantially equidistantly between adjacent turns with a substantially constant pitch p by applying tension between a first turn of said reinforcing member located at or near a first end of said reinforcing member and a second turn of said reinforcing member located at or near a second end of said reinforcing member;

wherein in an expanded in-use condition, the pitch p between adjacent successive turns is in the distance range of 4 cm to 15 cm;

wherein the helical member forms a tunnel being square or rectangular at any location along the length of the tunnel looking in a direction tangential to a centreline; and a radius of curvature of an innermost periphery of each corner portion of the helical member is in the range of 0.5 cm to 5 cm;

wherein the wire has a carbon content in the range of 0.04% to 0.20% by weight.

2. The reinforcing member as claimed in claim 1, wherein the ratio of the second width w2 to the first width w1 is in the range of 1 to 3 w2 to 1 w1.

3. The reinforcing member as claimed in claim 1, wherein, in an expanded in-use form of the helical member, the pitch p between successive turns is between 1 and 10 times the pitch p when the helical member is in a fully compacted state.

4. The reinforcing member as claimed in claim 1, wherein in an expanded in-use condition, the pitch between adjacent successive turns is in the distance range 5 cm to 10 cm.

5. The reinforcing member as claimed in claim 1, wherein the uniformity of pitch p of the helical member when held between first and second ends on a level surface is p + or −7%.

6. The reinforcing member as claimed in claim 1, wherein said wire comprises a smooth outer surface.

7. The reinforcing member as claimed in claim 1 wherein, in a newly manufactured form, a pitch between adjacent successive turns of said member is in the range 0 to 3 times an outside diameter of said wire.

8. The reinforcing member as claimed in claim 1 wherein, in an expanded in-use condition a pitch between adjacent successive turns of said member is in the range 1 to 30 times and outside diameter of said wire.

9. The reinforcing member as claimed in claim 1, wherein the radius of curvature of an inner most periphery of at least one of the corners of the helical member internal to the tunnel shaped coil is in the range of 1.0 cm to 3.0 cm.

* * * * *